US008684870B2

(12) United States Patent
Ito et al.

(10) Patent No.: US 8,684,870 B2
(45) Date of Patent: Apr. 1, 2014

(54) BALL

(75) Inventors: Shinichiro Ito, Tokyo (JP); Kazuya Seo, Yamagata (JP); Takeshi Asai, Ibaraki (JP); Norihiro Yuki, Hiroshima (JP)

(73) Assignee: Molten Corporation, Hiroshima (JP)

( * ) Notice: Subject to any disclaimer, the term of this patent is extended or adjusted under 35 U.S.C. 154(b) by 402 days.

(21) Appl. No.: 12/595,098

(22) PCT Filed: Apr. 10, 2008

(86) PCT No.: PCT/JP2008/000942

§ 371 (c)(1), (2), (4) Date: Oct. 8, 2009

(87) PCT Pub. No.: WO2008/132793

PCT Pub. Date: Nov. 6, 2008

(65) Prior Publication Data

US 2010/0137081 A1 Jun. 3, 2010

(30) Foreign Application Priority Data

Apr. 12, 2007 (JP) ..... 2007-104954
Jul. 19, 2007 (JP) ..... 2007-188154
Dec. 13, 2007 (JP) ..... 2007-321619

(51) Int. Cl.
*A63B 41/08* (2006.01)

(52) U.S. Cl.
USPC ..... 473/604; 473/596; 473/614

(58) Field of Classification Search
USPC ..... 473/614, 613, 603, 604, 595, 596, 597, 473/451, 351, 378, 383, 375
See application file for complete search history.

(56) References Cited

U.S. PATENT DOCUMENTS

| | | | | | |
|---|---|---|---|---|---|
| 1,265,036 | A | * | 5/1918 | Bendelow | 473/377 |
| 2,086,094 | A | * | 7/1937 | Reach | 473/613 |
| 2,135,210 | A | * | 11/1938 | Farrar | 473/383 |
| 2,194,674 | A | * | 3/1940 | Riddell | 473/597 |
| 4,266,773 | A | * | 5/1981 | Treadwell | 473/383 |
| 4,318,544 | A | * | 3/1982 | Brine, Jr. | 473/596 |
| 4,333,648 | A | | 6/1982 | Aoyama | |
| 4,438,924 | A | * | 3/1984 | Carr | 473/613 |
| 4,570,931 | A | * | 2/1986 | Martin | 473/596 |
| 4,874,169 | A | * | 10/1989 | Litchfield | 473/613 |

(Continued)

FOREIGN PATENT DOCUMENTS

| | | |
|---|---|---|
| JP | 61-127764 | 8/1986 |
| JP | 09-019516 | 1/1997 |

(Continued)

OTHER PUBLICATIONS

International Search Report for corresponding Application No. PCT/JP2008/000942 mailed Jun. 10, 2008.

(Continued)

*Primary Examiner* — Steven Wong
(74) *Attorney, Agent, or Firm* — Renner, Otto, Boisselle & Sklar, LLP

(57) ABSTRACT

A ball includes a ball body having a spherical surface, and at least one projection extending from the surface of the ball body. The projection extends in such a manner that the projection forcibly separates a laminar boundary layer generated on the surface of the ball body, and transitions the laminar boundary layer to a turbulent boundary layer.

12 Claims, 8 Drawing Sheets

(56) References Cited

U.S. PATENT DOCUMENTS

| | | | | |
|---|---|---|---|---|
| 4,991,842 | A * | 2/1991 | Finley | 473/596 |
| 5,228,687 | A * | 7/1993 | Luecke et al. | 473/596 |
| 5,588,648 | A * | 12/1996 | Stebbins | 473/451 |
| 5,735,761 | A * | 4/1998 | Palmquist | 473/596 |
| 6,290,615 | B1 | 9/2001 | Ogg | |
| 6,705,957 | B2 * | 3/2004 | Owens et al. | 473/372 |
| 6,908,662 | B2 * | 6/2005 | Pearce | 428/188 |
| 7,608,003 | B1 * | 10/2009 | Fusco et al. | 473/613 |
| 2004/0072639 | A1 * | 4/2004 | Thomas | 473/614 |
| 2004/0142780 | A1 * | 7/2004 | Estefano | 473/604 |
| 2005/0003146 | A1 | 1/2005 | Spath | |
| 2005/0079936 | A1 * | 4/2005 | Litchfield | 473/596 |
| 2006/0105866 | A1 * | 5/2006 | Ma | 473/603 |
| 2006/0148591 | A1 * | 7/2006 | Hebert et al. | 473/378 |
| 2006/0217220 | A1 * | 9/2006 | Davignon, II | 473/613 |
| 2007/0117662 | A1 * | 5/2007 | Ma | 473/604 |
| 2009/0325744 | A1 * | 12/2009 | Raynak et al. | 473/604 |
| 2010/0255940 | A1 * | 10/2010 | Nuernberg et al. | 473/604 |

FOREIGN PATENT DOCUMENTS

| | | |
|---|---|---|
| JP | 2003-513767 | 4/2003 |
| JP | 2005-537034 | 12/2005 |
| WO | 2004/056424 | 7/2004 |

OTHER PUBLICATIONS

Form PCT/ISA/237.

* cited by examiner

BALL

TECHNICAL FIELD

The present invention relates to a ball which a person directly or indirectly throws, kicks, and hits, and is used for various competitive sports, training, games, recreational activities, etc.

BACKGROUND ART

Among balls roughly divided into solid balls and hollow balls, one known example of the hollow balls includes a bladder filled with compressed air, a reinforcing layer formed on the bladder by winding a nylon filament on the bladder in every circumferential direction, a rubber covering layer formed on the reinforcing layer, and a skin layer formed of a plurality of leather panels bonded to the rubber covering layer (see, e.g., Patent Document 1). The ball thus configured is called a bonded ball.

In another known example of the ball different from the above example, as disclosed by Patent Document 2, for example, edges of a plurality of leather panels are sewn together to form a spherical skin layer, and a bladder is contained in the skin layer. The ball thus configured is called a sewn ball.

Still another example of the ball is disclosed by, for example, Patent Document 3. In this example, a plurality of woven fabric pieces are sewn together to form a spherical woven fabric layer. A bladder is contained in the spherical woven fabric layer, and a plurality of leather panels are bonded to the surface of the woven fabric layer to form a skin layer.

[Patent Document 1] Specification of U.S. Pat. No. 4,333,648

[Patent Document 2] Published Japanese Patent Publication No. H09-19516

[Patent Document 3] Pamphlet of International Publication WO/2004/56424

DISCLOSURE OF THE INVENTION

Problem that the Inventions is to Solve

A conventional ball forms a relatively stable path when it spins as it travels through the air. Therefore, a player can control the ball as intended.

However, when the ball traveling through the air does not spin or spins less (hereinafter, a ball in these states is regarded as a ball traveling without spin, and a ball in other states is regarded as a ball traveling with spin), the ball may form a vertically and/or laterally displaced path. Therefore, the ball may travel to a location displaced from a target location intended by the player. The conventional ball is thus disadvantageous in controllability when the ball does not spin.

In view of the foregoing point, the present invention was developed. The present invention provides a ball with improved controllability by suppressing the displacement of the path of the ball traveling through the air without spin.

Means of Solving the Problem

As a result of studies looking for a solution to the above-described problem, the inventors of the present invention have arrived at a conclusion that the displacement of the path of the ball traveling through the air without spin is derived from an aerodynamic characteristic of the ball.

Specifically, when the ball travels through the air without spin, a laminar boundary layer is generated on the surface of the ball, though it is not generated on the spinning ball. The laminar boundary layer gradually develops in a downstream direction along the surface of the ball, and separates from the ball surface at a predetermined position. Depending on conditions, the Karman voltex is generated behind the ball when the laminar boundary layer separates. The generated Karman voltex applies force to the ball in a direction perpendicular to the traveling direction of the ball, i.e., in a vertical or lateral direction (hereinafter, this force applied to the ball may be referred to as lateral force). That is, a possible cause of the displaced path of the ball traveling through the air without spin is the Karman voltex.

Therefore, it is assumed that suppressing the generation of the Karman voltex would suppress the displacement of the path of the ball traveling through the air without spin.

Paying attention to the fact that the Karman voltex is generated when the laminar boundary layer separates from the ball surface, but is not generated when a turbulent boundary layer separates, the inventors of the present invention configured the ball so that the laminar boundary layer, which is generated on the surface of the ball traveling through the air without spin, is transitioned to the turbulent boundary layer, thereby allowing the turbulent boundary layer to separate from the ball surface.

According to an aspect of the present invention, a ball includes: a ball body having a spherical surface; and at least one projection extending from the surface of the ball body.

The projection preferably extends in such a manner that the projection forcibly separates a laminar boundary layer generated on the surface of the ball body, and transitions the laminar boundary layer to a turbulent boundary layer.

As described above, the laminar boundary layer is generated on the surface of the ball body traveling through the air without spin. The projection extending from the surface of the ball body forcibly separates the laminar boundary layer, and reattaches the turbulent boundary layer on the surface of the ball body.

The reattached turbulent boundary layer separates from the surface of the ball body at a relatively downstream position in a direction of a flow applied to the ball body. The ball can suppress the generation of the Karman voltex because the turbulent boundary layer separates from the ball body surface, instead of the laminar boundary layer. This stabilizes the path of the ball traveling through the air without spin.

The turbulent boundary layer is inherently less likely to separate from the ball surface than the laminar boundary layer. Therefore, the position at which the turbulent boundary layer separates is downstream of the position at which the laminar boundary layer separates in the direction of the flow. When the turbulent boundary layer separates, a turbulent wake behind the ball body is relatively narrowed, thereby decreasing drag exerted on the ball. That is, the ball thus configured can decrease the drag as compared with the conventional ball, thereby involving an accompanying advantage of increased travel distance.

The projection is preferably arranged upstream of a position at which the laminar boundary layer separates from the ball body in a direction of a uniform flow applied to the ball body.

Specifically, the projection needs to be arranged in a position upstream of a position at which the laminar boundary layer spontaneously separates from the ball body so that the projection forcibly separates the laminar boundary layer. In this manner, the laminar boundary layer generated on the surface of the ball body can forcibly be separated, and can be transitioned to the turbulent boundary layer.

The projection is preferably arranged in axial symmetry with a predetermined virtual axis passing a center of the ball body.

Specifically, the ball body having the spherical surface has axial symmetry as its geometrical characteristic. Therefore, the projection provided on the surface of the ball body is preferably arranged in axial symmetry. When the virtual axis is aligned with the direction of the flow, the laminar boundary layer is generated on the surface of the ball body in axial symmetry with the virtual axis. The axially symmetrical layer is forcibly separated, and is transitioned to the turbulent boundary layer by the axially symmetrical projection.

The projection preferably extends in such a manner that the projection stabilizes a path of the ball body traveling through the air to a predetermined path.

The projection may extend in such a manner that the projection stabilizes the path of the ball body by reducing fluid force exerted on the ball body traveling through the air substantially without spin.

The projection may be arranged in a stripe pattern. Alternatively, the projection may be arranged in a stripe pattern in two directions different from each other, thereby forming a lattice pattern. The stripe or lattice pattern may be formed at regular intervals.

The surface of the ball body may be formed of a plurality of panels.

On the surface of the ball body formed of the plurality of panels, recesses are formed between the panels. Therefore, the surface of the ball body becomes uneven. Providing the above-described projection on the surface of the ball body which is previously made uneven is more effective in suppressing the displacement of the path of the ball traveling through the air without spin.

Effect of the Invention

As described above, according to the present invention, the laminar boundary layer generated on the surface of the ball body traveling through the air without spin is transitioned to the turbulent boundary layer by the projection extending from the surface of the ball body. Therefore, the generation of the Karman voltex, which is a cause of the displacement of the ball path, is suppressed, thereby allowing the ball traveling through the air without spin to form a stable path. This can improve controllability of the ball.

DESCRIPTION OF CHARACTERS

1 Ball body
14 Leather panel
2 Projection
B Volleyball

BEST MODE FOR CARRYING OUT THE INVENTION

Hereinafter, embodiments of the present invention will be described with reference to the drawings. The following description of the preferred embodiments is provided only for explanation purpose, and does not limit the present invention, an object to which the present invention is applied, and use of the invention.

Figure 1:
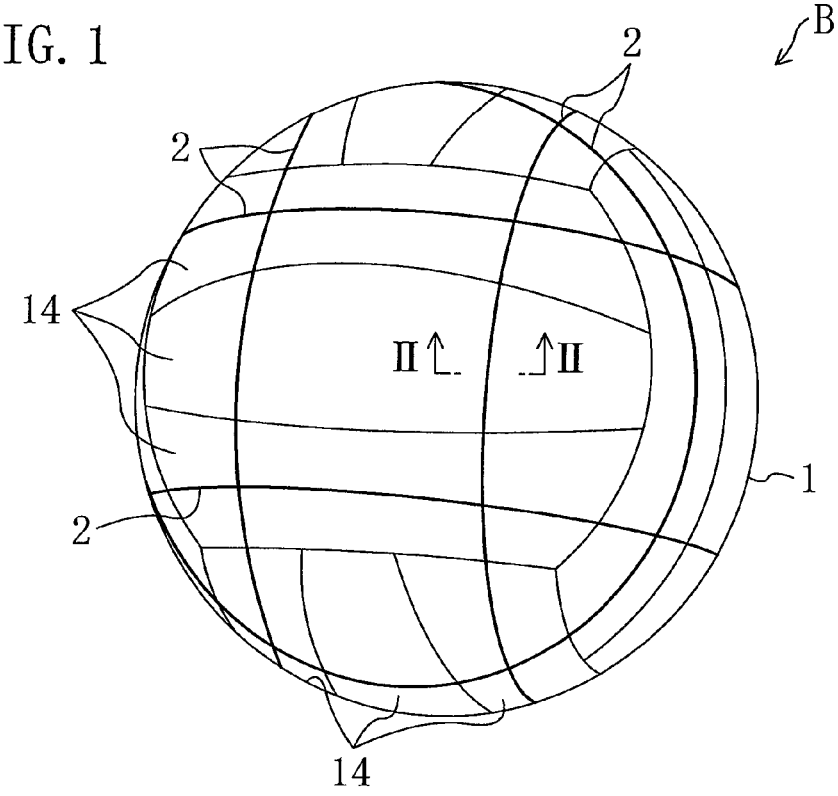
FIG. 1 is a perspective view illustrating a volleyball according to an embodiment of the present invention.

FIG. 1 shows a ball of the present embodiment. Hereinafter, the ball will be described using a volleyball as an example. However, the ball is not limited to the volleyball. For example, the ball may be those used for other competitive sports, e.g., soccer balls, handballs, basketballs, etc.

The volleyball B includes a ball body 1, and projections 2 extending from the surface of the ball body 1.

Figure 2:
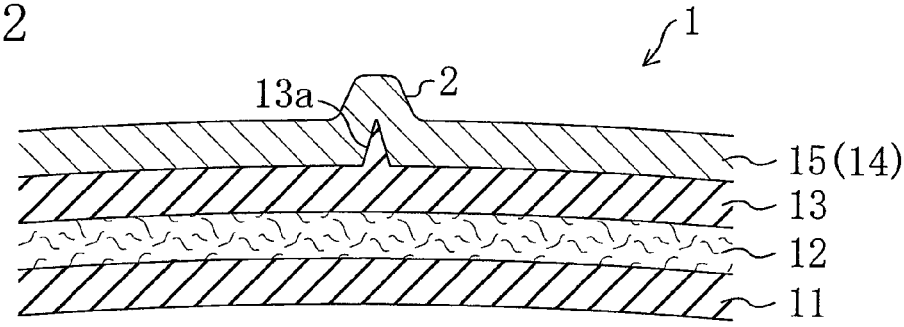
FIG. 2 is a partial cross-sectional view of the volleyball (a cross-sectional view taken along the line II-II of FIG. 1).
Figure 3:
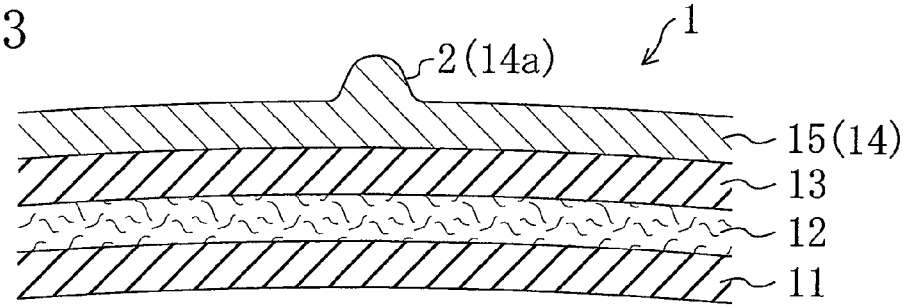
FIG. 3 is a partial cross-sectional view illustrating a volleyball of a different structure from the volleyball of FIG. 2.
Figure 4:
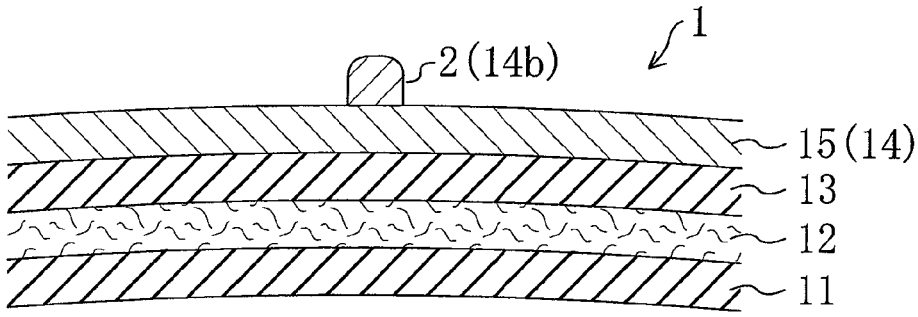
FIG. 4 is a partial cross-sectional view illustrating a volleyball of a different structure from the volleyballs of FIGS. 2 and 3.

The ball body 1 of the present embodiment is configured as a so-called bonded ball as shown in FIG. 2, 3 or 4. Specifically, the ball body 1 includes a hollow spherical bladder 11, a reinforcing layer 12 covering the surface of the bladder 11, a rubber covering layer 13 coated on the reinforcing layer 12 and made of, e.g., natural rubber, and a skin layer 15 which is formed of a plurality of leather panels 14 (18 pieces in the volleyball B) bonded to the surface of the rubber covering layer 13 with an adhesive, and forms a spherical surface of the ball body 1.

The bladder 11 is made of an air-impermeable elastic material, e.g., butyl rubber, etc. The bladder 11 is filled with compressed air through a valve which is not shown.

The reinforcing layer 12 is made of a thread layer formed by winding a several thousand meter long nylon filament or the like on the bladder 11 in every circumferential direction, or is made of a fabric layer formed by sewing a plurality of woven fabric pieces into a spherical shape. The reinforcing layer 12 stabilizes the quality of the ball. Specifically, the reinforcing layer 12 improves sphericity, durability, ability to keep the sphericity, and resistance to change over time.

Each of the leather panels 14 is made of natural or artificial leather, and is in the predetermined shape of a strip. Suppose that the surface of the ball body 1 is divided in six substantially rectangular regions, i.e., top, bottom, right, left, front and rear regions, corresponding to six axes passing the center of the ball body (hereinafter, the axes may be referred to center axes), respectively, three leather panels sewn together along their edges are arranged in each of the regions. The skin layer 15 is formed by covering the surface of the ball body 1 with the leather panels 14.

Though not shown, an edge of each of the leather panels 14 is beveled from a reverse side relative to the thickness direction. Therefore, a recess having a substantially V-shaped cross section is formed at each of junctions between the edges of the leather panels 14 bonded to each other on the surface of the ball body 1. That is, the surface of the volleyball B is provided with predetermined unevenness in advance.

FIGS. 2 to 4 schematically show the cross section of the ball body 1 for easy understanding. In these drawings, the layers appear to have substantially the same thickness, but actually, they have different thicknesses.

Figure 6:
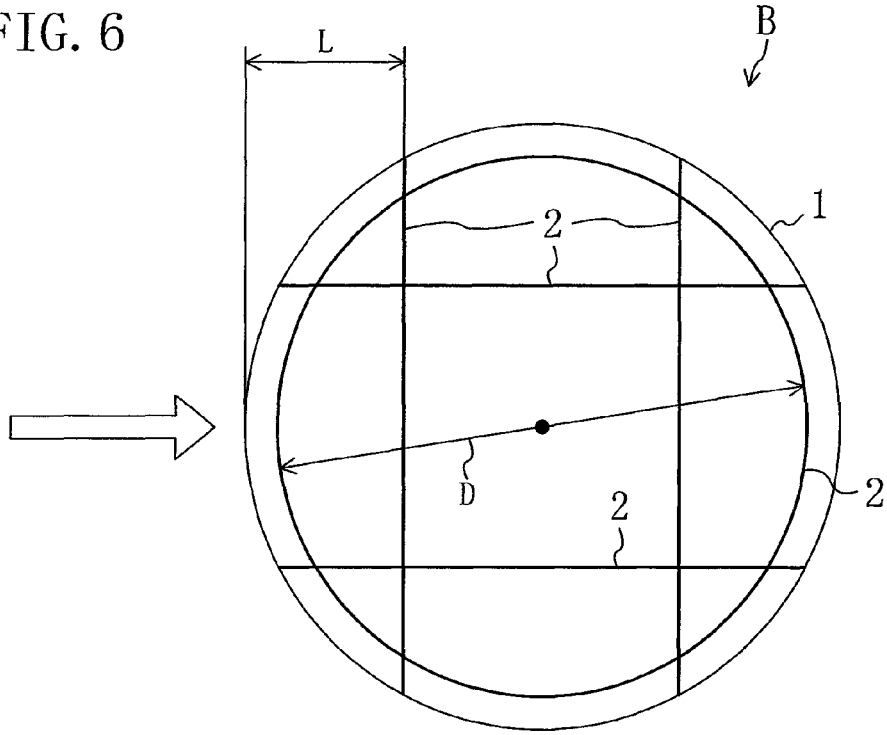
FIG. 6 is a view illustrating the position of the projection relative to a ball body.

As shown in FIGS. 1 and 6 (in FIG. 6, the leather panels 14 are omitted), the volleyball B of the present embodiment has six projections 2 corresponding to the six axes extending from the top, bottom, right, left, front and rear regions of the ball. In the drawings, five projections 2 are shown, but the remaining one projection on the rear region of the ball body 1 is not shown. Each of the projections 2 is in the shape of a continuous ring centered about the corresponding axis.

For example, the projections 2 may be formed on the surface of the ball body 1 in the following manner. Specifically, as shown in FIG. 2, a protrusion 13*a* extending in a radially outward direction is formed integrally with the rubber covering layer 13. The protrusion 13*a* makes the leather panel 14 bonded to the rubber covering layer 13 extend radially outward from the ball body 1, thereby forming the projection 2 extending from the surface of the ball body 1.

The protrusion 13*a* may be formed integrally with the rubber covering layer 13, but the protrusion 13*a* is not limited to the integrally formed protrusion. For example, though not shown, the protrusion 13*a* may be formed by bonding a protrusion material of a predetermined height by adhesion or the like to the surface of the rubber covering layer 13.

Alternatively, as shown in FIG. 3, a protrusion 14*a* may be formed integrally with the leather panel 14 to extend from the surface of the leather panel 14, thereby forming the projection 2 extending from the surface of the ball body 1.

Further, instead of forming the protrusion 14*a* integrally with the leather panel 14, for example, the projection 2 extending from the surface of the ball body 1 may be formed by bonding a protrusion material 14*b* to the surface of the leather panel 14 by adhesion or the like as shown in FIG. 4.

Figure 5:
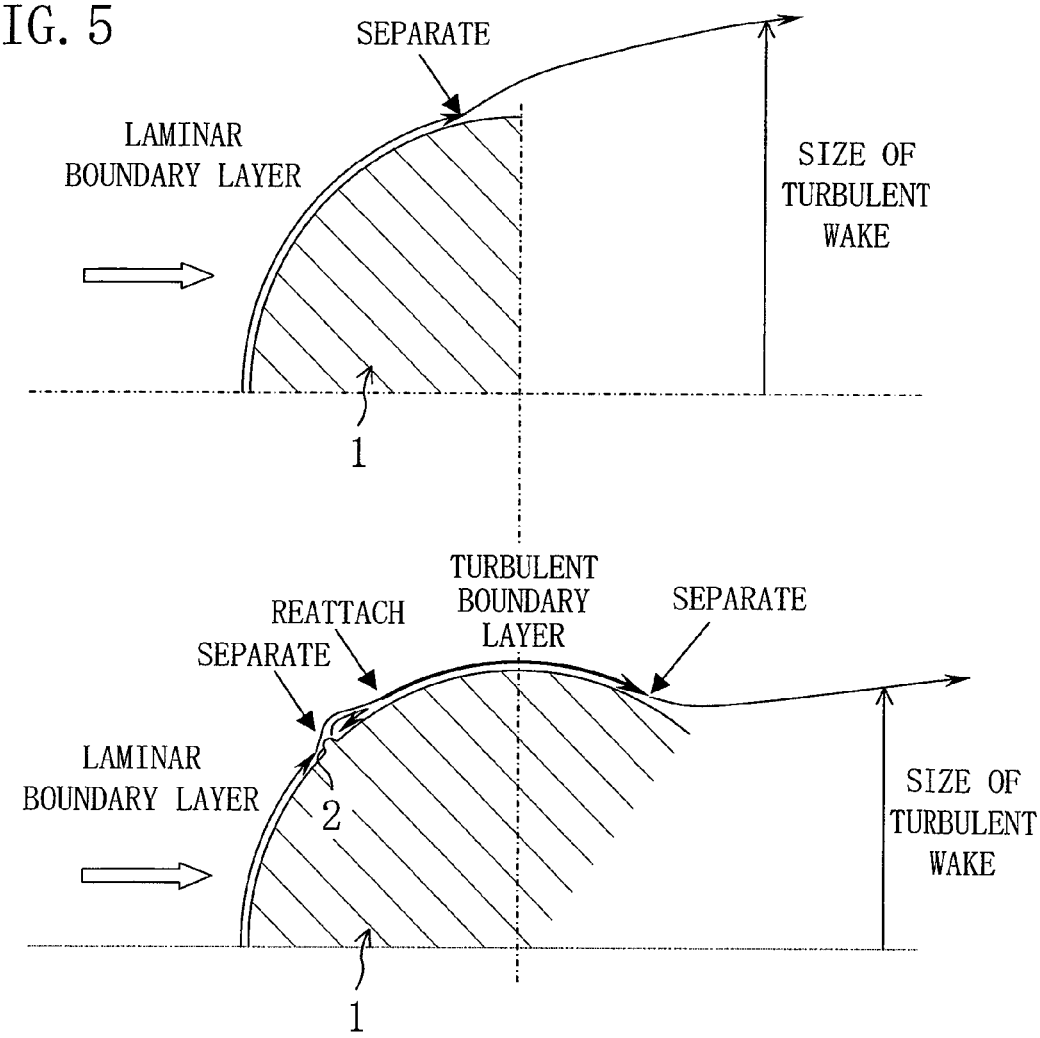
FIG. 5 shows in an upper view a laminar boundary layer separating from a surface of the ball, and shows in a lower view a turbulent boundary layer transitioned from the laminar boundary layer by a projection separating from the surface of the ball.

As shown in FIG. 5, the projections 2 extending from the surface of the ball body 1 have the function of forcibly separating a laminar boundary layer generated on the surface of the ball body 1, and reattaching a turbulent boundary layer on the surface of the ball body 1.

Specifically, when the volleyball B travels through the air without spin, the laminar boundary layer is generated on the surface of the ball body 1 as shown in an upper view of FIG. 5. The laminar boundary layer develops downstream along the surface of the ball body 1 in a direction of a flow. Then, at a certain position in the direction of the flow, the laminar boundary layer separates from the surface of the ball body 1. Depending on conditions, the Karman voltex is generated behind the ball body 1 when the laminar boundary layer separates. The generated Karman voltex applies force to the ball body 1 in a direction perpendicular to the direction of the flow, i.e., in a vertical or lateral direction, thereby displacing a path of the ball.

In contrast, since the volleyball B includes the projection 2, the projection 2 forcibly separates the laminar boundary layer generated on the surface of the ball body 1, and reattaches a turbulent boundary layer on the surface of the ball body 1 as shown in a lower view of FIG. 5. As a result, the turbulent boundary layer separates from the surface of the ball body 1, thereby suppressing the generation of the Karman voltex. Thus, even if the ball does not spin, the displacement of the ball path is suppressed. Therefore, the ball path is stabilized.

The number of the projections 2 formed on the ball body 1 is not particularly limited. At least one projection 2 may sufficiently work. However, it is preferable that the projection 2 does not shift the center of gravity of the ball body 1. In this volleyball B, the six axes corresponding to the top, bottom, right, left, front, and rear regions of the ball body 1 are assumed, thereby providing the six projections 2. However, a suitable number of axes may be assumed relative to the ball body 1, and the projections 2 corresponding to the axes may be provided.

Referring to FIG. 6, etc., the arrangement and the shape of each of the projections 2 will be described.

As described above, each of the projections 2 is in the shape of a ring centered about the corresponding one of the six axes passing the center of the ball body 1 (see FIG. 6). Therefore, each of the projections 2 is in axial symmetry with the corresponding axis. This is because the ball body 1 having the spherical surface has axial symmetry.

Figure 7:
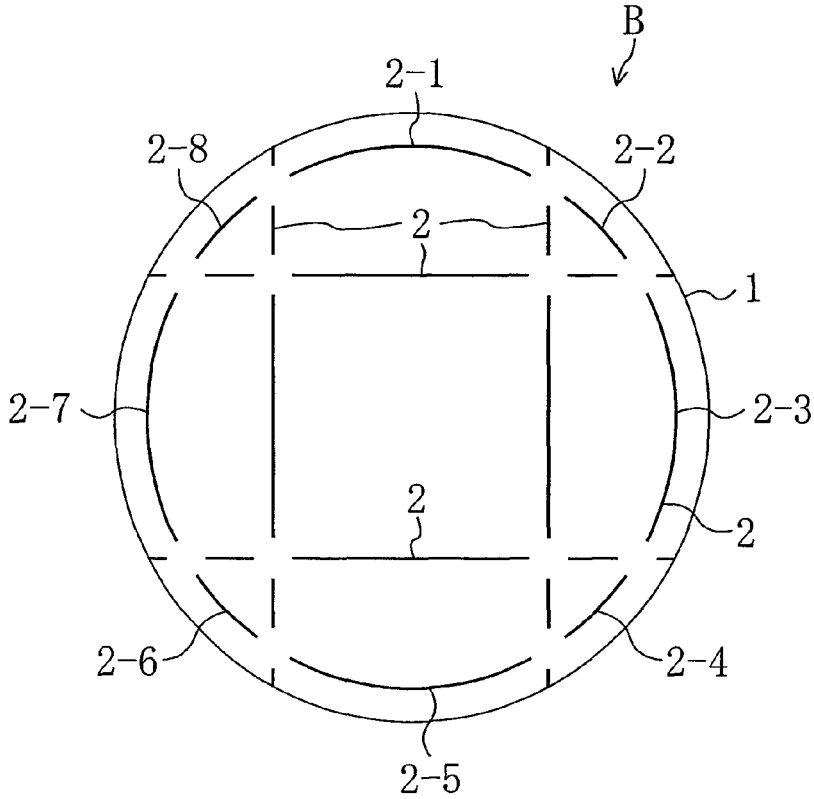
FIG. 7 is a front view illustrating another structure of the projection.

Each of the ring-shaped projections 2 is not necessarily formed continuously in the circumferential direction. For example, each of the projections 2 may suitably be divided into pieces as shown in FIG. 7. In an example of FIG. 7, the projections 2 are divided at their intersections, i.e., each of the projections 2 is divided into eight long and short pieces 2-1 to 2-8.

Figure 8:
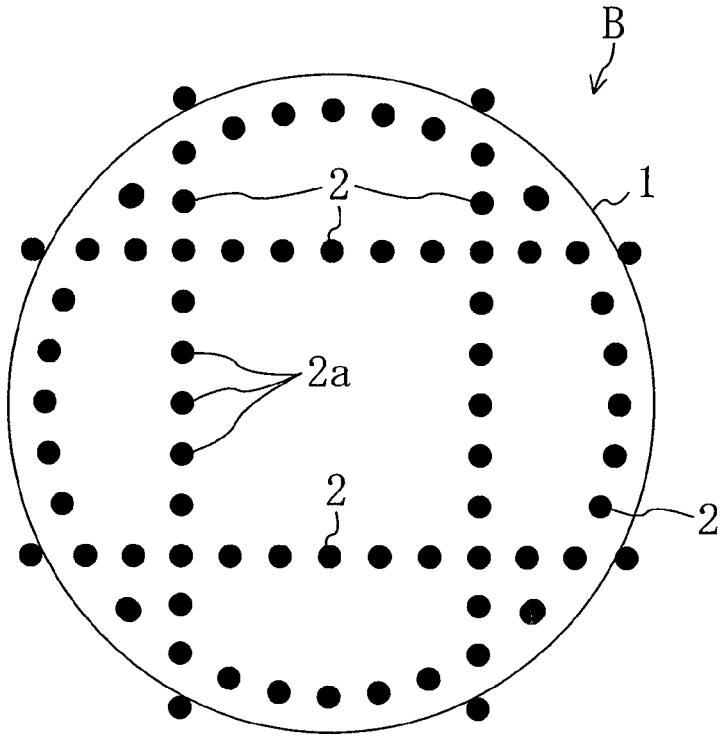
FIG. 8 is a front view illustrating still another structure of the projection.

For example, as shown in FIG. 8, a plurality of dot-shaped projections 2*a* may be arranged in a ring-shaped configuration to form the above-described projection 2.

Figure 9:
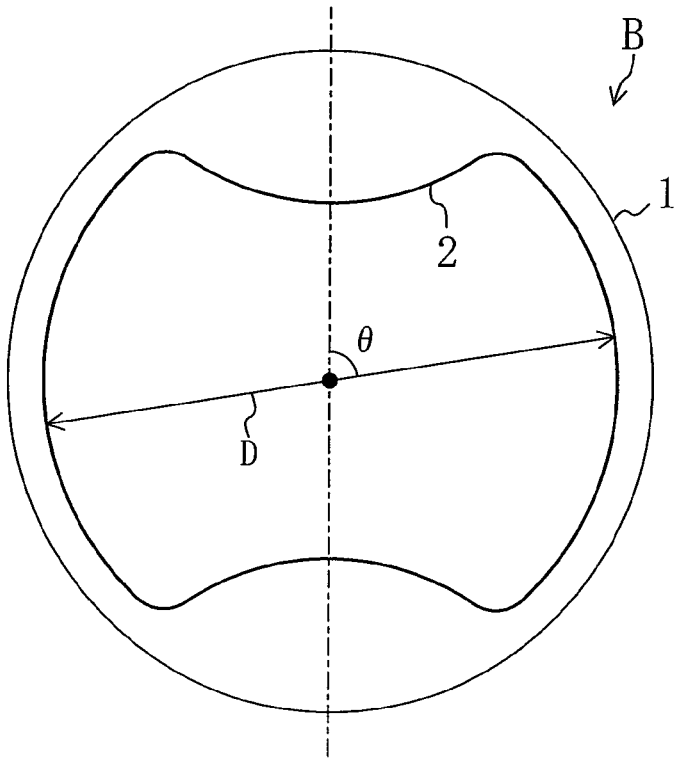
FIG. 9 is a front view illustrating still another structure of the projection.

The projection 2 is not limited to the ring-shaped configuration. For example, as shown in FIG. 9, when viewed in a center axis direction perpendicular to the sheet of the drawing, the projection 2 may be configured so that a diameter D periodically varies depending on an angle θ around the center axis. In FIG. 9, only one projection 2 is shown for easy understanding, but the number of the projections 2 is not limited as described above. Though not shown, the projection 2 may be arranged in a corrugated ring shaped configuration around the center axis. The features of the projections shown in FIGS. 7, 8 and 9 may be combined with each other.

Figure 10:
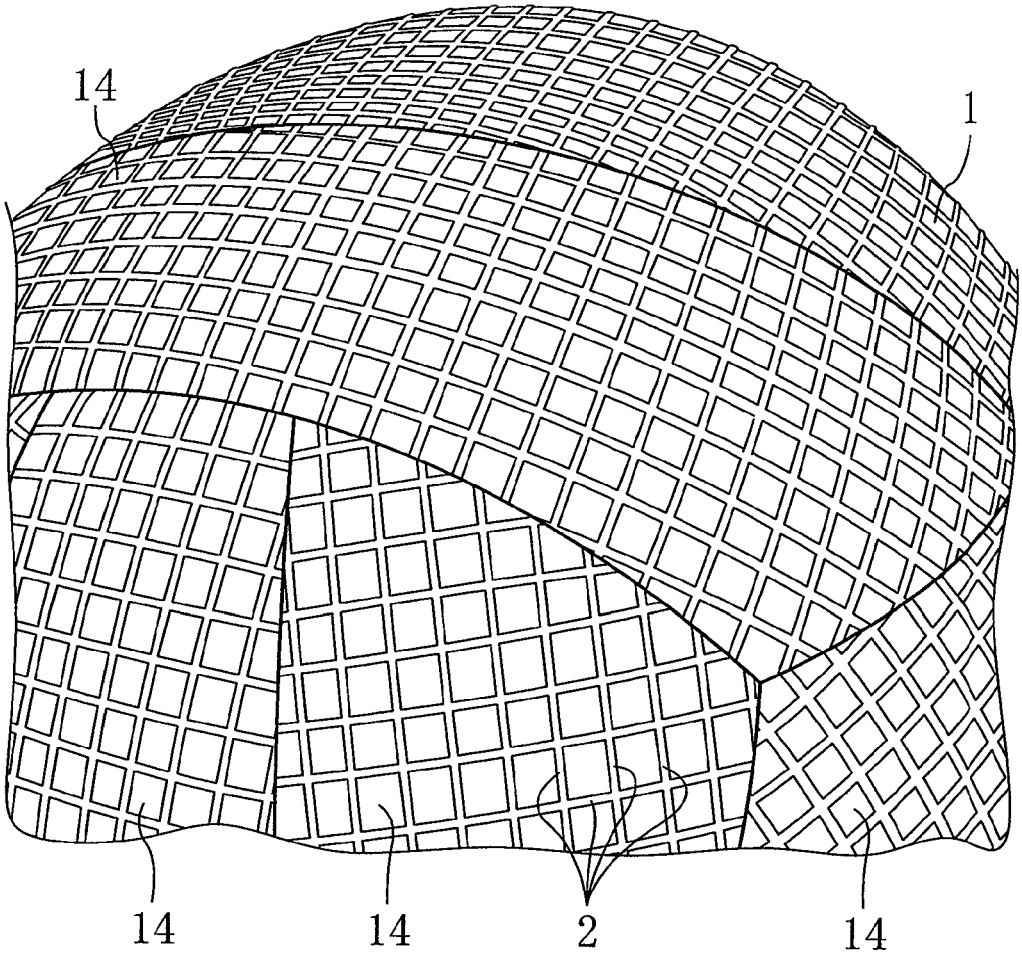
FIG. 10 is an enlarged perspective view illustrating still another structure of the projection.

For example, multiple center axes passing the center of the ball body 1 may be assumed, and the dot-shaped projections 2*a* shown in FIG. 8 may be arranged in the ring-shaped, or corrugated ring-shaped configuration to correspond to each of the multiple center axes, thereby forming multiple projections 2. As a result, the dot-shaped projections 2*a* may be formed on the entire spherical surface of the ball body 1. Further, as shown in FIG. 10 illustrating an enlargement of the surface of the volleyball (the ball body 1), the projections 2 may be arranged in two directions orthogonal to each other on each of the leather panels 14, thereby forming a lattice pattern. This is equivalent to arranging a plurality of linear projections 2. The projections 2 forming the lattice pattern may be arranged at regular intervals. The ball thus designed offers an advantage of suppressing the generation of the Karman voltex by reattaching the turbulent boundary layer as described above. In addition, as described below in detail, increase in surface roughness of the ball offers another advantage of stabilizing the path of the ball in a wide range of ball speed.

FIG. 10 depicts a ball body having a spherical surface formed by three or more panels. The three or more panels may be arranged such that at least three of the three or more panels are arranged adjacent to one another. Each of the panels may have an outer surface including a lattice pattern represented by a continuous linear convex portion and a lattice of discontinuous plural concave portions. For each concave portion not located along a border of the outer surface of each panel, the continuous linear convex portion may surround each of the plural concave portions. The discontinuous concave portions of adjacent panels may be continuous with one another.

As shown in FIG. 10, the portion of the continuous linear convex portion surrounding each concave portion may have a shape with a polygon tubular vertical plane of projection. The lattice of discontinuous plural concave portions may extend across the outer surface of each panel in a repeating pattern. The continuous convex portions of respective adjacent panels may not be continuous with one another. The concave portions located along the border of the outer surface of a given panel may also not be completely surrounded by the continuous convex portion of the given panel.

Figure 11A:
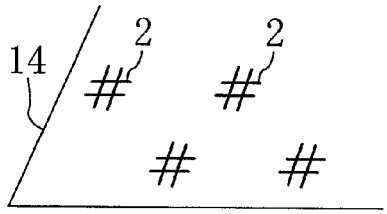
FIG. 11A is a conceptual diagram illustrating still another structure of the projection arranged in a lattice pattern.
Figure 11B:
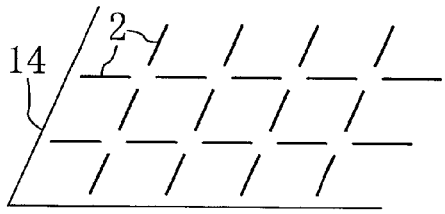
FIG. 11B is a conceptual diagram illustrating still another structure of the projection arranged in a lattice pattern.
Figure 11C:
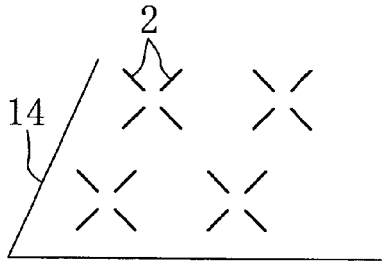
FIG. 11C is a conceptual diagram illustrating still another structure of the projection arranged in a lattice pattern.
Figure 11D:
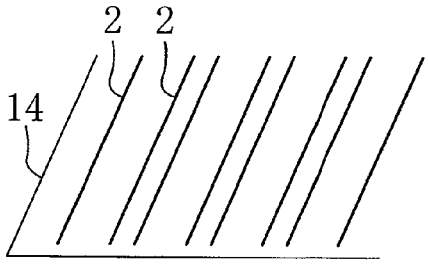
FIG. 11D is a conceptual diagram illustrating still another structure of the projection arranged in a stripe pattern.
Figure 11E:
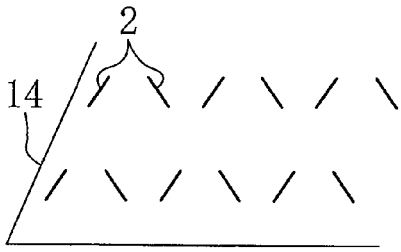
FIG. 11E is a conceptual diagram illustrating still another structure of the projection arranged in a lattice pattern.

Other examples of the lattice pattern formed by the projections 2 are shown in FIGS. 11A to 11E. Specifically, in an example of FIG. 11A, each of the projections 2 is in the shape of "#", and the "#"-shaped projections 2 are arranged in two directions orthogonal to each other. In an example of FIG. 11B, the projections 2 in the shape of relatively short linear segments are arranged in two directions orthogonal to each other. In an example of FIG. 11C, each of the projections 2 is in the shape of X, and the X-shaped projections 2 are arranged in two directions orthogonal to each other. Further, in an example of FIG. 11D, the projections 2 in the shape of relatively long linear segments are arranged in a single direction. The intervals between the projections 2 may vary periodically as shown in FIG. 11D, or may be set to regular intervals. In an example of FIG. 11E, each of the projections 2 is in the shape of V, and the V-shaped projections 2 are arranged in two direction orthogonal to each other.

The position (L) of each of the projections 2 in a direction of a flow (a direction of an open arrow in FIG. 6) is upstream of a position at which the laminar boundary layer spontaneously separates from the ball body 1 when a uniform flow is applied to the ball body 1 (i.e., a position at which the laminar boundary layer separates in the upper view of FIG. 5). This is because of the need to forcibly separate the laminar boundary layer generated on the surface of the ball body 1 by the projection 2, and to transition the laminar boundary layer to the turbulent boundary layer.

As described above, the projection 2 extending from the surface of the ball body 1 can suppress the generation of the Karman voltex when the ball travels through the air without spin. This stabilizes the path of the ball, thereby allowing the volleyball B to travel through the air as a player intended. That is, the volleyball B has high controllability when it travels through the air without spin.

The projection 2 transitions the laminar boundary layer generated on the surface of the ball body 1 to the turbulent boundary layer. As compared with the case where the laminar boundary layer separates from the ball body 1, a turbulent wake behind the ball is narrowed when the turbulent boundary layer separates from the ball body 1 as shown in the lower view of FIG. 5, thereby decreasing drag exerted on the ball. Therefore, the volleyball B can offer an accompanying advantage of increased travel distance of the ball.

Examples

Now, specifically implemented examples will be described. First, a commercially available volleyball (206 mm in diameter) including 18 leather panels bonded to the surface, and a 200 mm diameter ball having a smooth surface, i.e., a surface free from unevenness (hereinafter referred to as a smooth ball), were prepared.

The commercially available volleyball as prepared above was used as a ball of Conventional Example. Further, a linear material having a 0.45 mm diameter circular cross section was bonded to the surface of a commercially available volleyball to form a ring of a predetermined diameter centered about a predetermined center axis. In this way, volleyballs (Examples 1 to 4), each of which having a projection extending from the ball surface, were formed.

Specifically, Example 1 is a ball provided with a projection having a diameter of 109 mm, Example 2 is a ball provided with a projection having diameter D of 151 mm, and Example 3 is a ball provided with a projection having diameter D of 187 mm. Example 4 is a ball provided with six projections corresponding to six axes and having diameter D of 187 mm.

The smooth ball as prepared above was used as a ball of Comparative Example 1. Further, in the same manner as the formation of the balls of Examples, a ball (Comparative Example 2) was formed by bonding a linear material having a 0.45 mm diameter circular cross section to a predetermined position on the surface of a smooth ball in the shape of a ring. Specifically, Comparative Example 2 is a ball provided with a projection having diameter D of 151 mm. Dimensional data of the balls of Examples, Conventional Example, and Comparative Examples are shown in Table 1.

TABLE 1

| | Conventional Example | Ex. 1 | Ex. 2 | Ex. 3 | Ex. 4 | Com. Ex. 1 | Com. Ex. 2 |
|---|---|---|---|---|---|---|---|
| Type | Volleyball | Volley ball | Volley ball | Volley ball | Volley ball | Smooth ball | Smooth ball |
| Diameter | ø206 | ø206 | ø206 | ø206 | ø206 | ø200 | ø200 |
| Diameter of linear material | — | ø0.45 | ø0.45 | ø0.45 | ø0.45 | — | ø0.45 |
| Number of projections | — | 1 | 1 | 1 | 6 | — | 1 |
| Diameter of projection | — | ø109 | ø151 | ø187 | ø187 | — | ø151 |

A wind tunnel test was performed on the above-described examples to check aerodynamic characteristics of the balls. Specifically, wind velocity was varied from 4 m/sec to 20 m/sec at 2 m/sec intervals, and drag on the ball located near an air supply opening of the wind tunnel was measured at each wind velocity. The balls provided with the projection(s) (Examples 1 to 4 and Comparative Example 2), as shown in the lower view of FIG. 5, were located so that the center axis corresponding to the projection coincides with a direction of a flow, and that the projection opposes to the direction of the flow. Then, every ball was checked as to variations in drag coefficient Cd with respect to Reynolds number Re. The Reynolds number Re is calculated by the equation $Re=\rho\times v\times d/\mu$, and the drag coefficient Cd is calculated by the equation $Cd=D/(\frac{1}{2}\times\rho\times v^2\times(\pi d^2/4))$. Character ρ indicates air density [$kg/m^3$], v indicates a flow rate [m/s], d indicates a diameter of the ball [m], μ indicates a viscosity coefficient [Pa·s], and D indicates drag [N].

When the laminar boundary layer separates from the ball surface, it separates at a relatively upstream position, thereby widening a turbulent wake behind the ball, and relatively increasing the drag on the ball (see the upper view of FIG. 5). In contrast, when the turbulent boundary layer' separates from the ball surface, it separates at a relatively downstream position, thereby narrowing the turbulent wake behind the ball, and relatively decreasing the drag on the ball (see the lower view of FIG. 5).

Therefore, if the ball has a small Reynolds number which drastically reduces the drag coefficient Cd (a critical Reynolds number), the turbulent boundary layer is generated on the surface of the ball even when the ball is in a low speed range, and the turbulent boundary layer separates from the ball surface. This ball can be regarded as a ball which suppresses the generation of the Karman voltex.

Figure 12:
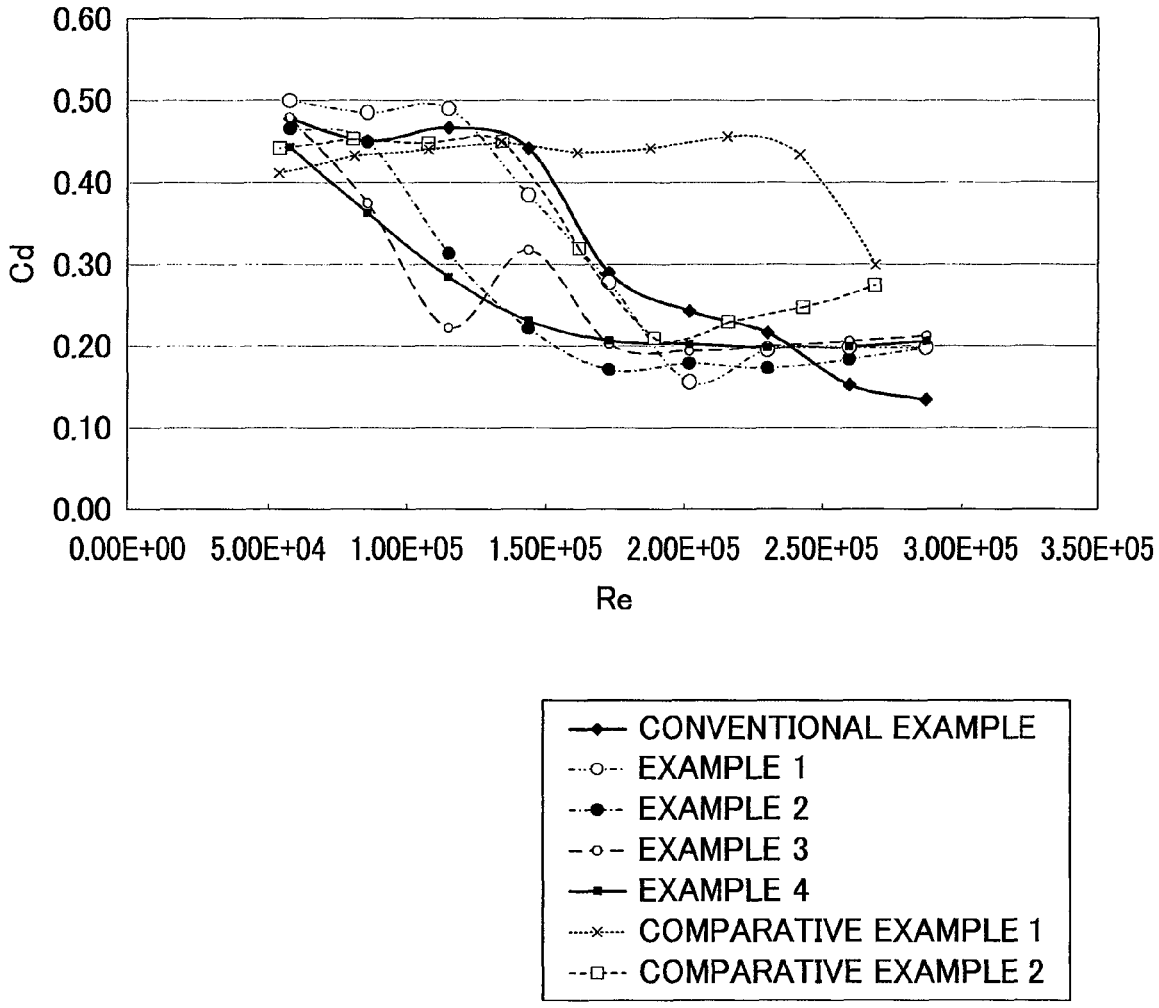
FIG. 12 is a graph illustrating the experimental results related to an aerodynamic characteristic of balls of Examples.

FIG. 12 is a graph showing the results of the wind tunnel test performed on the balls of Examples, Conventional Example, and Comparative Examples. First, referring to this graph, comparison between Conventional Example and Comparative Example 1 indicates that the critical Reynolds number of Comparative Example 1 is significantly higher than that of Conventional Example (the critical Reynolds number of Conventional Example is about $1.5\times10^5$, and that of Comparative Example 1 is about $2.5\times10^5$). Specifically, the laminar boundary layer stays on the surface of the ball of Comparative Example 1 having the smooth surface until the flow rate arrives at a relatively high rate, and then separates. This may lead to the generation of the Karman voltex. Therefore, the ball of Comparative Example 1 is likely to displace its path when the ball travels through the air without spin.

In comparison between Comparative Examples 1 and 2, the critical Reynolds number of Comparative Example 2 is about $1.4\times10^5$, which is significantly smaller than that of Comparative Example 1, and is almost the same as that of Conventional Example. Presumably, the projection formed on the ball surface transitioned the laminar boundary layer generated on the ball surface to the turbulent boundary layer at a relatively low flow rate, and then the turbulent boundary layer separated. Thus, the projection formed on the ball surface has a function of suppressing the generation of the Karman voltex.

In comparison between Examples and Conventional Example, the critical Reynolds numbers of Examples 1 to 4 are about $1.2\times10^5$, about $0.9\times10^5$, about $0.6\times10^5$, and about $0.6\times10^5$, respectively, which are smaller than the critical Reynolds number of Conventional Example (about $1.5\times10^5$). This indicates that each of the balls of Examples transitioned the turbulent boundary layer generated on the surface of the ball to the turbulent boundary layer at a lower flow rate than the ball of Conventional Example, and then separated the turbulent boundary layer. That is, since the balls of Examples allow the turbulent boundary layer to separate at a lower flow rate than the ball of Conventional Example, they suppress the generation of the Karman voltex to a greater extent than the ball of Conventional Example. In other words, the balls of Examples can suppress the displacement of the path of the ball traveling through the air without spin to a greater extent than the ball of Conventional Example.

In particular, the ball of Example 4 shows monotone decrease of the drag coefficient Cd in response to increase of the Reynolds number. This indicates that increasing the surface roughness of the ball by forming the plurality of projections offers the effect of smoothening the transition of the laminar boundary layer to the turbulent boundary layer in response to variations in Reynolds number, in addition to the effect of accelerating the above-described transition of the laminar boundary layer to the turbulent boundary layer by the projection. Therefore, the ball including the multiple projections like the ball of Example 4 improves the stability of the ball path not only in the range of low ball speed, but in the range of high ball speed. Thus, the ball path is expected to be stabilized within a wide range of ball speed.

Figure 13A:
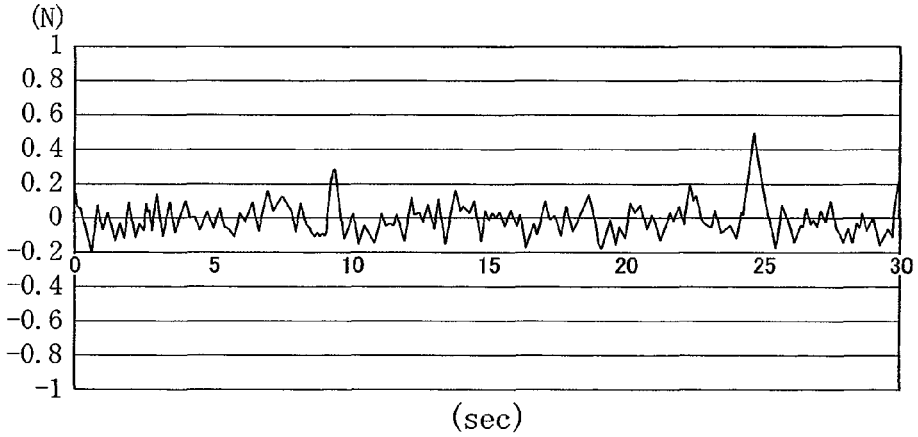
FIG. 13A is a graph illustrating the experimental results related to lateral force exerted on a ball of Conventional Example.
Figure 13B:
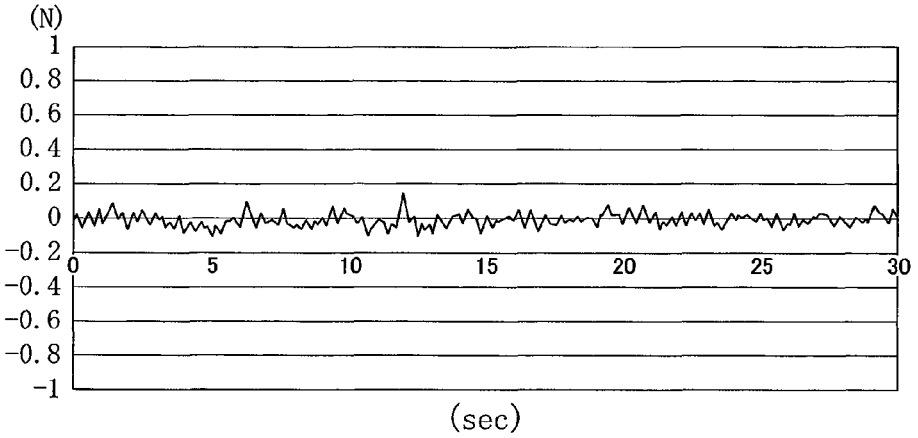
FIG. 13B is a graph illustrating the experimental results related to lateral fore exerted on a ball of Example 4.
Figure 13C:
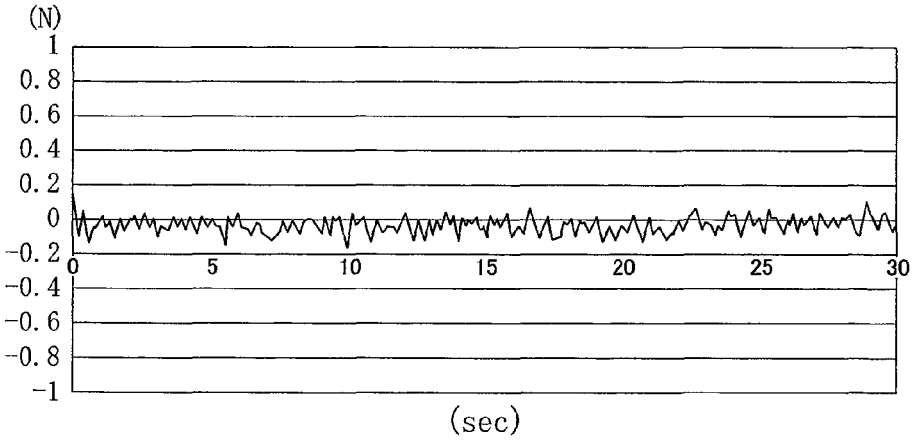
FIG. 13C is a graph illustrating the experimental results related to lateral force exerted on a ball having a projection arranged in a lattice pattern.

A wind tunnel test was performed on the balls of Conventional Example and Example 4 to measure variations in lateral force exerted on the ball over time. FIGS. 13A and 13B show the measurement results. The results indicate that the lateral force was exerted on the ball of Conventional Example to shake the ball, with a relatively large amplitude (see FIG. 13A). On the other hand, the ball of Example 4 scarcely experienced the shaking caused by the lateral force (see FIG. 13B). Further, the wind tunnel test was also performed on a ball provided with the projection arranged in a lattice pattern as shown in FIG. 10 to measure variations in lateral force over time. FIG. 13C shows the measurement results. The results indicate that this ball scarcely experienced the shaking caused by the lateral force, like the ball of Example 4. This confirms that the ball of Example 4 can stabilize the path of the ball as compared with the ball of Conventional Example.

As described above, the ball to which the present invention can be applied is not limited to the volleyball B. The present invention is applicable to various types of balls used for competitive sports, training, games, recreational activities, etc. Particular examples of the balls for the competitive sports include soccer balls, handballs, basketballs, etc.

The ball is not limited to the bonded ball. The present invention can be applied to balls of various structures. For example, the invention is applicable to not only the hollow balls, but the solid balls.

An example of the hollow ball except for the bonded ball may be a so-called sewn ball including a spherical skin layer formed by sewing a plurality of leather panels along their edges, and a bladder contained in the skin layer. In applying the present invention to the sewn ball, a protrusion may be formed integrally with the leather panel to form the projection, or a protrusion material may be bonded by adhesion to the surface of the leather panel to form the projection.

Another example of the hollow ball may be formed by sewing a plurality of woven fabric pieces together to form a spherical woven fabric layer, containing a bladder in the woven fabric layer, and bonding a plurality of leather panels to the surface of the woven fabric layer. In applying the present invention to the ball thus configured, a protrusion may be formed integrally with the leather panel, or a protrusion material may be bonded by adhesion to the leather panel to form the protrusion, in the same manner as the formation of the sewn ball. For example, the projection extending from the ball surface may be formed by bonding the protrusion material to the woven fabric layer, and bonding the leather panel thereto by adhesion.

INDUSTRIAL APPLICABILITY

As described above, the present invention can suppress the displacement of the path of the ball traveling through the air without spin, thereby improving the controllability of the ball. Therefore, the invention is useful for various balls.

The invention claimed is:

1. An inflatable ball comprising a ball body having a spherical surface formed by three or more panels, wherein:

the spherical surface is configured to suppress lateral forces acting on the ball body as the ball body travels through air substantially without spin;

the three or more panels are arranged such that at least three of the three or more panels are arranged adjacent to one another;

each of the panels has an outer surface including a lattice pattern represented by a continuous linear convex portion and a lattice of discontinuous plural concave portions;

for each concave portion not located along a border of the outer surface of each panel, the continuous linear convex portion surrounds each of the plural concave portions; and the majority of discontinuous concave portions of adjacent panels are continuous with one another.

2. The ball of claim 1, wherein the portion of the continuous linear convex portion surrounding each concave portion has a shape with a polygon tubular vertical plane of projection.

3. The ball of claim 1, wherein the lattice of discontinuous plural concave portions extend across the outer surface of each panel in a repeating pattern.

4. The ball of claim 1, wherein the panels are made of leather.

5. The ball of claim 1, wherein the continuous convex portions of respective adjacent panels are not continuous with one another.

6. The ball of claim 1, wherein the concave portions located along the border of the outer surface of a given panel are not completely surrounded by the continuous convex portion of the given panel.

7. A ball comprising a bladder and ball body having a spherical surface formed by three or more panels, wherein:

the spherical surface is configured to suppress lateral forces acting on the ball body as the ball body travels through air substantially without spin;

the three or more panels are arranged such that at least three of the three or more panels are arranged adjacent to one another;

each of the panels has an outer surface including a lattice pattern represented by a continuous linear convex portion and a lattice of discontinuous plural concave portions;

for each concave portion not located along a border of the outer surface of each panel, the continuous linear convex portion surrounds each of the plural concave portions; and the majority of discontinuous concave portions of adjacent panels are continuous with one another.

8. The ball of claim 7, wherein the portion of the continuous linear convex portion surrounding each concave portion has a shape with a polygon tubular vertical plane of projection.

9. The ball of claim 7, wherein the lattice of discontinuous plural concave portions extend across the outer surface of each panel in a repeating pattern.

10. The ball of claim 7, wherein the panels are made of leather.

11. The ball of claim 7, wherein the continuous convex portions of respective adjacent panels are not continuous with one another.

12. The ball of claim 7, wherein the concave portions located along the border of the outer surface of a given panel are not completely surrounded by the continuous convex portion of the given panel.

* * * * *